US005080526A

United States Patent [19]

Waters

[11] Patent Number: 5,080,526

[45] Date of Patent: Jan. 14, 1992

[54] EROSION PROTECTION STRUCTURE

[75] Inventor: Charles M. Waters, Norfolk

[73] Assignee: Dunlop Limited, United Kingdom

[21] Appl. No.: 602,249

[22] PCT Filed: May 16, 1989

[86] PCT No.: PCT/GB89/00527

§ 371 Date: Jan. 17, 1991

§ 102(e) Date: Jan. 17, 1991

[87] PCT Pub. No.: WO89/11566

PCT Pub. Date: Nov. 30, 1989

[30] Foreign Application Priority Data

May 17, 1988 [GB] United Kingdom ..... 8811599
May 24, 1988 [GB] United Kingdom ..... 8812260

[51] Int. Cl.[5] ..... E02B 3/04; E02B 3/06

[52] U.S. Cl. ..... 405/29; 405/16; 405/25; 405/30

[58] Field of Search ..... 52/607, 608, 648; 405/15, 16, 21, 23, 25-30, 33; D25/32, 35, 114, 115, 118

[56] References Cited

U.S. PATENT DOCUMENTS 1,875,668 9/1932 Sheldon .
2,835,112 5/1958 Monnet ..... 405/29
2,844,005 7/1958 Rehfeld ..... 405/29
3,204,721 9/1965 Park ..... 52/648 X
3,380,253 4/1968 Vita .
3,417,533 12/1968 Sparling ..... 52/607 X
3,974,611 8/1976 Satterthwaite ..... 52/648 X
4,431,337 2/1984 Iwasa ..... 405/30
4,711,057 12/1987 Lew et al. ..... 52/648 X

FOREIGN PATENT DOCUMENTS 745380 11/1966 Canada ..... 405/16
1223539 2/1971 United Kingdom .

*Primary Examiner*—Dennis L. Taylor
*Assistant Examiner*—John A. Ricci
*Attorney, Agent, or Firm*—Stevens, Davis, Miller & Mosher

[57] ABSTRACT

An erosion protection unit (7), comprising a tetrahedral frame comprising six outer elongate members (9) arranged in the outline of a tetrahedron, and a triaxial central strut arrangement (11) comprising three struts (13, 15, 17) arranged mutually perpendicular to one another and passing through the geometric center of the tetrahedron, such that each outer member is braced by a strut passing from its center to the center of a second opposite outer member.

6 Claims, 3 Drawing Sheets

EROSION PROTECTION STRUCTURE

FIELD OF THE INVENTION

The invention relates to erosion protection structures primarily for use in artificial barrier reefs to provide sheltered harbours.

Artificial barrier reefs are in use in many areas and they are typically made up of a plurality of erosion protection units collected together to form a mass. The erosion protection units are typically solid concrete members. Many different shapes of erosion protection units are produced but the most common shapes used are tetrapods and quadrapods which are illustrated in FIG. 1 of the accompanying drawings.

Tetrahedral solid blocks and hollow tetrahedral blocks are also produced. However, neither of these designs has proved as popular and effective as tetrapods or quadrapods.

SUMMARY OF THE INVENTION

According to the invention there is provided an erosion protection unit, comprising a tetrahedral frame comprising six outer elongate members arranged in the outline of a tetrahedron, and a triaxial central strut arrangement comprising of three struts arranged mutually perpendicular to one another and passing through the geometric centre of the tetrahedron, such that each outer member is braced by a strut passing from its centre to the centre of a second opposite outer member.

Preferably the structure is a regular tetrahedron such that each face of the tetrahedral frame describes an equilateral triangle.

The erosion protection unit can be installed singly or in multipals in a regular packed formation, with open spacing, or preferably in a random interrelationship. The application includes the formation of artificial barrier reefs, retention of land slip, flow retarding and diverting barriers, deadman anchorage, support stools, erosion shielding and blast shielding.

The tetrahedral arrangement is extremely effective at resisting displacement by force applied at any point and ensures that the structure functions equally effectively regardless of its orientation.

Because the unit is not a solid unit but is a frame, when the units are randomly arranged, the units often interlock to increase the normal high level of self stability of the individual units.

Moreover, because the structure is a frame structure, but has great stability, the unit can give greater stability than a solid unit of the same mass. Moreover, the central strut arrangement increases the wave energy dissipation of the unit to give a much stronger structure than the simple hollow tetrahedron.

The central triaxial bracing lying with mutually perpendicular axes provides a very stable arrangement which relieves stress within the outer members.

The reduction in sectional area of the units as a result of the centre bracing results in approximately 50% material and weight saving compared with tetrapods and quadrapods in artificial barrier reef collection.

Preferably the frame is made of a settable composition which is more preferably concrete. Preferably the centre strut arrangement is integrally mounted with the six outer frame members.

It is possible for a single unit to be cast in concrete using four identical mould sections. In order to do this, preferably the six outer members are substantially circular in cross-section but not completely circular in cross-section to allow for mould simplicity and demoulding convenience.

In this way the mould can be made up of four identical sections one of which would form the base and the other three forming the sides of the unit.

Such a mould structure allows a unit to be cast through one opening at the apex and would be entirely self-venting.

BRIEF DESCRIPTION OF THE DRAWINGS

Examples of an erosion protection unit and a mould to make it will now be described and contrasted with the prior art, with reference to the accompanying drawings, in which.

DESCRIPTION OF THE FIRST EMBODIMENT

Figure 1A:
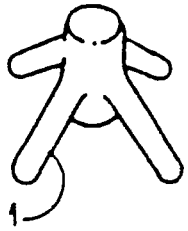
FIG. 1A PRIOR ART
FIG. 1 is a schematic perspective view of a selection of erosion protection units of the prior art.
Figure 1B:
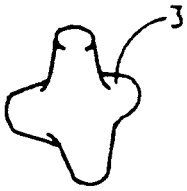
FIG. 1B PRIOR ART
Figure 1C:
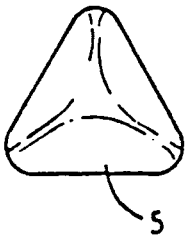
FIG. 1C PRIOR ART

FIG. 1 is a perspective view which shows a number of different shaped units which are at present used as erosion protection units to form artificial barrier reefs. The figure shows a quadrapod 1, a tetrapod 3 and a solid tetrahedron 5.

Figure 3A:
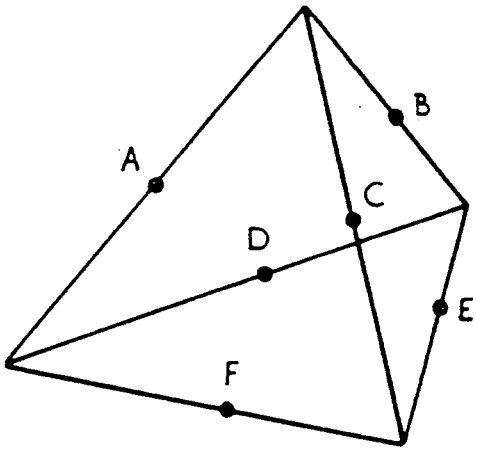
FIGS. 3A and 3B depict the axial relationship of the frame work of the unit.
Figure 3B:
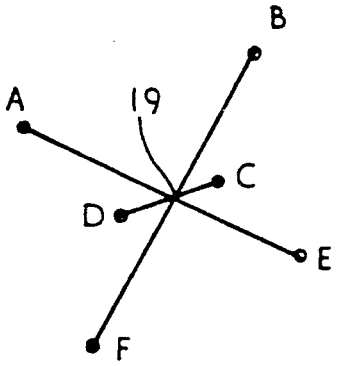

The erosion protection units of the invention 7 comprises a frame made up of six outer members 9 arranged in the outline of a tetrahedron. A central bracing strut arrangement 11 is triaxial and comprises three members 13, 15 and 17 all mutually perpendicular. The struts 13, 15 and 17 pass through a point 19 shown in FIG. 3B which is the geometric centre of the frame defined by the outer members 9. Each outer member 9 is braced by a strut which passes from the centre of the member to the centre of a second opposite member. This is shown in detail in FIGS. 3A and 3B where the configuration of the strut is shown in detail. This arrangement results in considerable structural stability and dissipates stress through the members effectively so that the elongate members 9 and strut members 13 can be made of a small cross-section.

Figure 4:
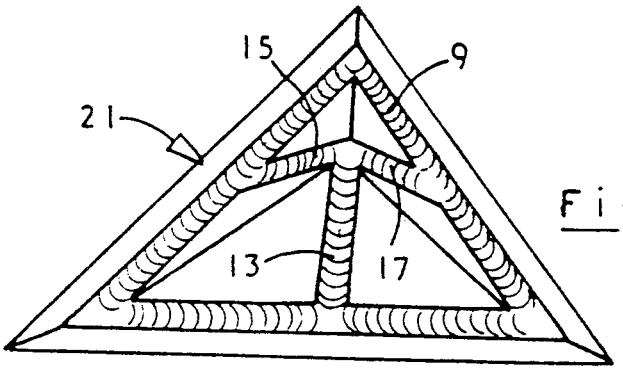
FIG. 4 is a schematic perspective view of part of the mould.
Figure 5:
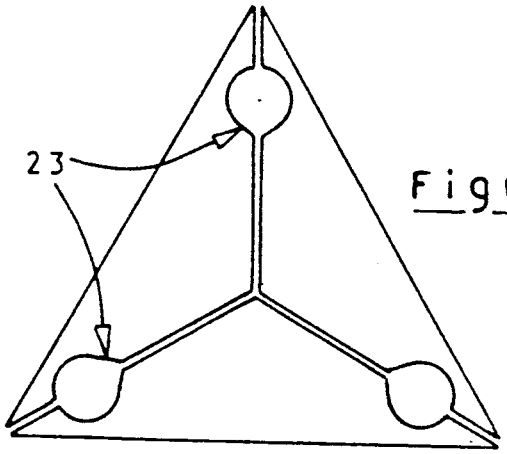
FIG. 5 is a schematic view showing the shape of the outer members.

The unit is one integral moulded concrete member which is mould using a mould made up of four identical sections 21 as shown in FIG. 4. Each mould section is a shallow pyramid having channels cut into it to define the outer elongate members 9 and the struts 13, 15 and 17. The section of the struts 13, 15 and 17 are circular but the section of the outer members 9 is not completely circular but trails tangentially shown at 23 on FIG. 5 to allow for mould simplicity and demoulding convenience. This facilitates mould withdrawal.

At the central struts 13, 15 and 17 the lateral plane of the mould break around the struts is perpendicular to the direction of mould removal so they can be circular in cross-section.

In this way the mould is made up such that the unit can be cast through one single opening at the apex.

The cast unit would not be greatly stressed if the three side sections of the mould were broken down at a very early stage of cure leaving the structure substantially supported on the base section. On this basis 75% of the mould section stock could enjoy a very short manufacturing re-cycle and would be likely to facilitate two castings per shift.

SUMMARY OF THE SECOND EMBODIMENT

In this embodiment there is provided a coastal protection unit, comprising a tetrahedral frame comprising six outer elongate members arranged in the outline of a tetrahedron, a triaxial central strut arrangement comprising three struts arranged mutually perpendicular to one another and passing through the geometric centre of the tetrahedron, such that each outer member is braced by a strut passing from its centre to the centre of the second opposite outer member, and four apex struts, arranged to pass from each apex of the tetrahedral frame to the geometric centre of the tetrahedron.

These struts brace the tetrahedral frame so that a very strong structure is produced which gives extremely effective wave energy dissipation.

Preferably the tetrahedron is a regular tetrahedron such that each face of the tetrahedral frame describes an equilateral triangle.

Although an adaptation of the coastal protection unit which omits the four apex struts can be packed together at random to form artificial barrier reefs, the more effective wave dissipation deriving from the incorporation of the apex struts makes the unit particularly useful in the construction of groynes and breakwaters in which a set of units are arranged in a regularly placed line.

Preferably each unit comprises an integrally moulded concrete unit. It is possible for a single unit to be cast in concrete using four identical mould sections.

BRIEF DESCRIPTION OF THE DRAWINGS OF THE SECOND EMBODIMENT

Figure 6:
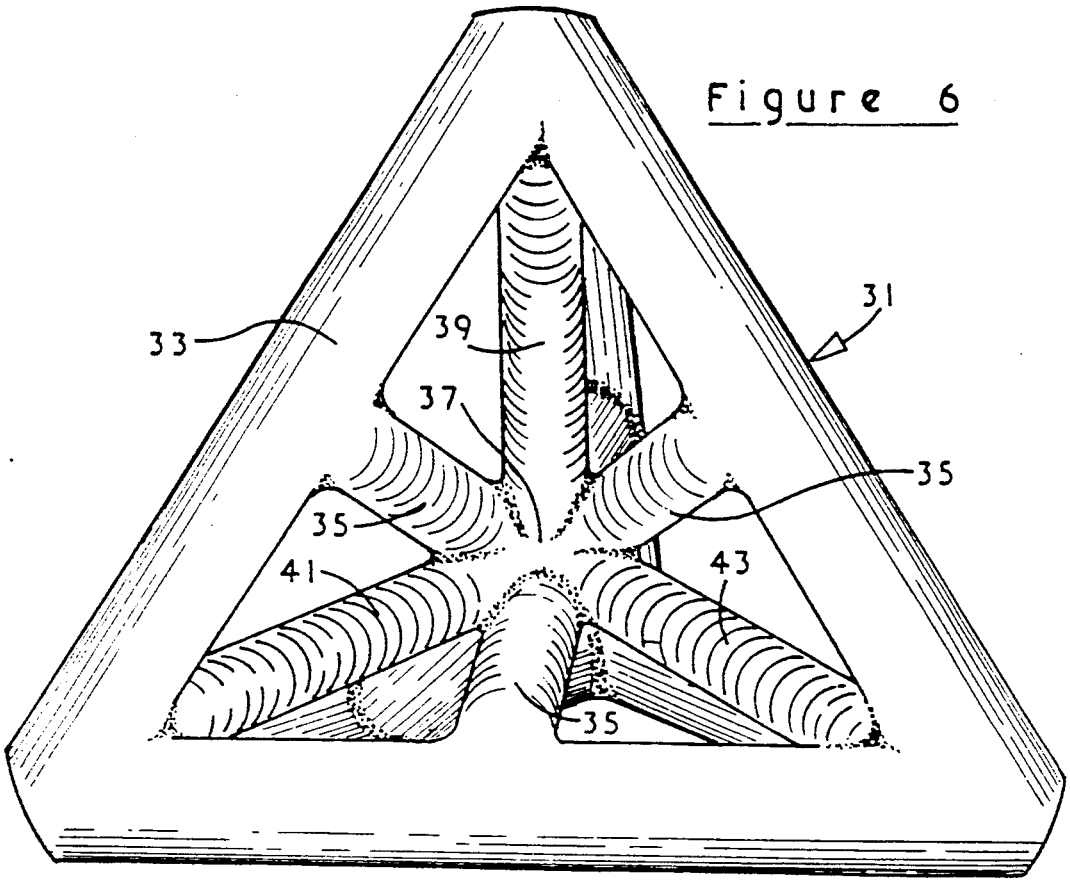
FIGS. 6, 7A and 7B show a second embodiment.
Figure 7A:
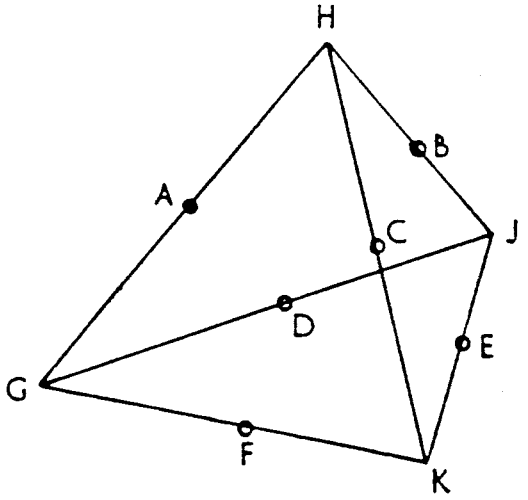
Figure 7B:
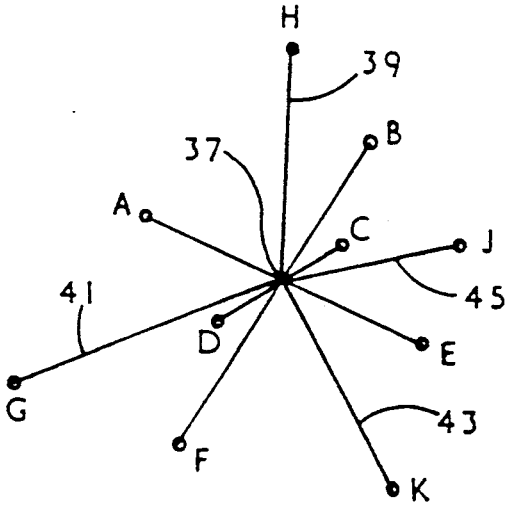

FIG. 6 is a perspective view of a coastal protection structure in accordance with the invention; and FIGS. 7A and 7B depict the axial relationship of the frame work of the unit.

DESCRIPTION OF THE SECOND EMBODIMENT

Figure 2:
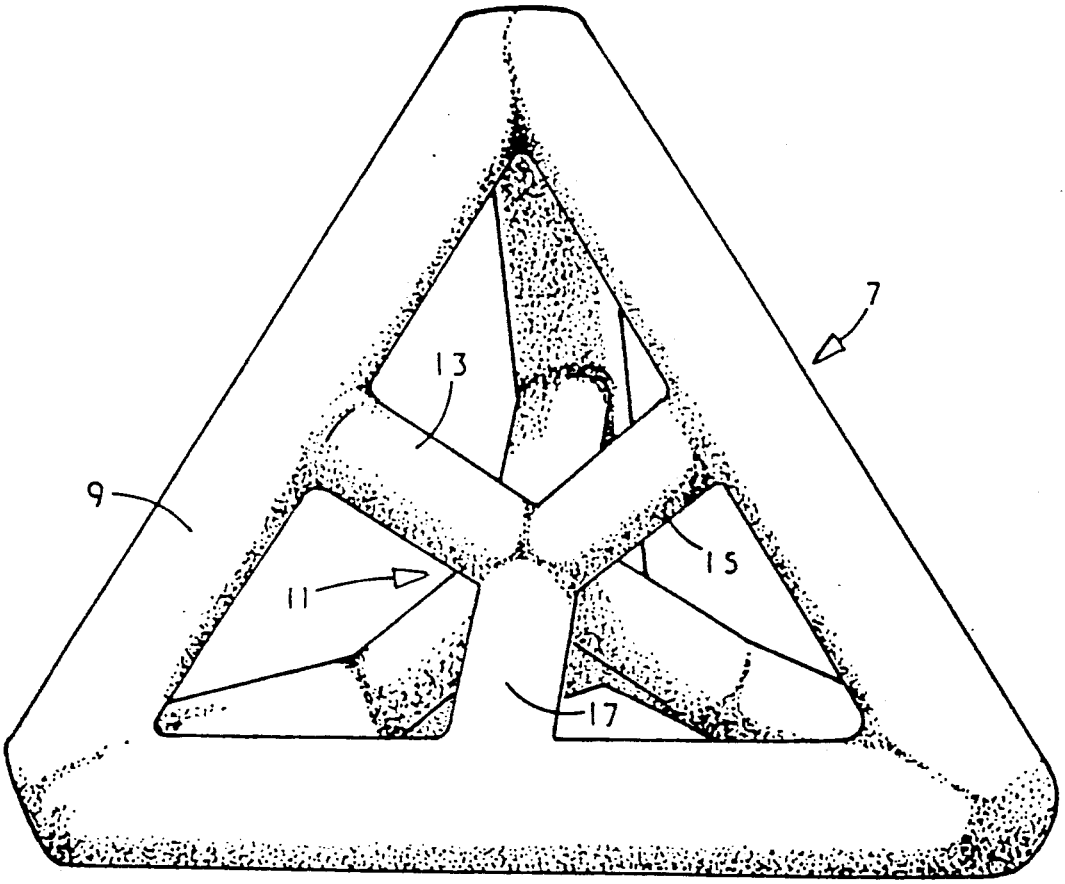
FIG. 2 is a perspective view of an erosion protection structure in accordance with the invention.

The erosion protection unit of the invention 31 comprises a frame made up of six outer members 33 arranged in the outline of a tetrahedron. A central triaxial strut arrangement 35 comprises three members all mutually perpendicular. The struts pass through a point shown in FIG. 2B which is the geometric centre of the frame defined by the outer members 33. Each outer member 33 is braced by a strut which passes from the centre of the member to the centre of the second opposite member. This is shown in detail in FIGS. 7A and 7B where the configuration of the struts are shown in detail.

This arrangement results in considerable structural stability and dissipates stress through the members effectively so that the elongate members 33 and strut members can be made of small cross-section. The bracing strut arrangement also includes four apex struts 39, 41, 43 and 45. The apex strut passes from an apex of the tetrahedron to the geometric centre 37 of the frame. The strut arrangement gives very good wave dissipation qualities and therefore the units can be used to make up coastal protection structures where the primary purpose such as groynes and breakwaters require a high level of immediate wave energy dissipation.

I claim:

1. An erosion protection unit characterised in that it comprises a tetrahedral frame comprising six outer elongate members (9) arranged in the outline of a tetrahedron, and a triaxial central strut arrangement (11) comprising of three struts (13, 15, 17) arranged mutually perpendicular to one another and passing though the geometric centre of the tetrahedron, such that each outer member (9) is braced by a strut (13, 15, 17) passing from its centre to the centre of a second opposite outer member (9).

2. An erosion protection unit according to claim 1 characterised in that the six outer elongate members (9) are arranged in the outline of a regular tetrahedron such that each face of the tetrahedral frame describes an equilateral triangle.

3. An erosion protection unit according to claim 1 characterised in that the frame is made of a settable composition.

4. An erosion protection unit according to claim 3 characterised in that the centre strut arrangement (11) is integrally moulded with the six outer frame members (9).

5. An erosion protection unit according to claim 4 characterised in that the unit is cast in concrete using four identical mould sections, the six outer members (9) being substantially, but not completely, circular in cross-section.

6. An erosion protection unit according to claim 1 characterised in that four apex struts (39, 41, 43, 45) are arranged to pass from each apex of the tetrahedral frame to the geometric centre (37) of the tetrahedron.

* * * * *